US005350024A

United States Patent [19]

Gruber

[11] Patent Number: 5,350,024

[45] Date of Patent: Sep. 27, 1994

[54] DRILL PIPE

[75] Inventor: Heinz Gruber, Seesen-Rhüden, Fed. Rep. of Germany

[73] Assignee: GD-Anker GmbH, Seesen-Rhüden, Fed. Rep. of Germany

[21] Appl. No.: 988,969

[22] PCT Filed: May 22, 1992

[86] PCT No.: PCT/EP92/01149

§ 371 Date: Feb. 26, 1993

§ 102(e) Date: Feb. 26, 1993

[87] PCT Pub. No.: WO93/04257

PCT Pub. Date: Mar. 4, 1993

[30] Foreign Application Priority Data

Aug. 17, 1991 [DE] Fed. Rep. of Germany ..... 4127249

[51] Int. Cl.[5] ..... E21B 17/16; E21B 17/22

[52] U.S. Cl. ..... 175/323; 166/242

[58] Field of Search ..... 175/323; 166/242; 138/154, DIG. 11, 122, 173

[56] References Cited

U.S. PATENT DOCUMENTS 4,365,678 12/1982 Fitch ..... 175/323
4,537,428 8/1985 Landriault ..... 285/397 X

FOREIGN PATENT DOCUMENTS 0274719 7/1988 European Pat. Off. .
936082 7/1956 Fed. Rep. of Germany .
1170887 5/1964 Fed. Rep. of Germany .
1483840 3/1970 Fed. Rep. of Germany .
3234406 3/1984 Fed. Rep. of Germany .
3828335 11/1989 Fed. Rep. of Germany .

*Primary Examiner*—William P. Neuder
*Attorney, Agent, or Firm*—Michael J. Striker

[57] ABSTRACT

In order to achieve improved flow properties for a flushing medium charged with rock particles freed during the drilling phase, an injection drilling anchor is provided with anchor rods, coupling members, injection valves, an intermediate member containing a non-return valve, as well as drill head, which are designed such that these components are connected one to the other below one another always by screw fittings, so that in the assembled state one has a fully homogeneous structure from the drill head upwards. The drill head has an external thread extending uniformly over the full length and consequently has a uniform diameter, so that after drilling has taken place, starting from the mouth of the borehole, a spacer can be pushed within the borehole along the full length of the borehole over the anchor rods to any desired point. The anchor rods are provided over their full length with a uniform internal threading, sot hat a cutting to a particular length does not hinder their utility for use in the framework of the injection drilling anchor. The coupling members, the injection valves, intermediate member and the drill head for this purpose comprise tubular cylinders which correspond in terms of their internal and eternal threading with the anchor rods and which each have a stop function for the positional screwing together of the parts.

11 Claims, 3 Drawing Sheets

Fig. 2
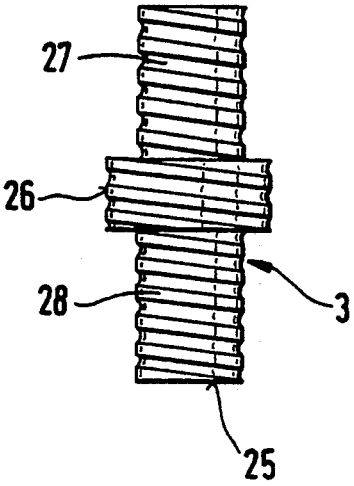
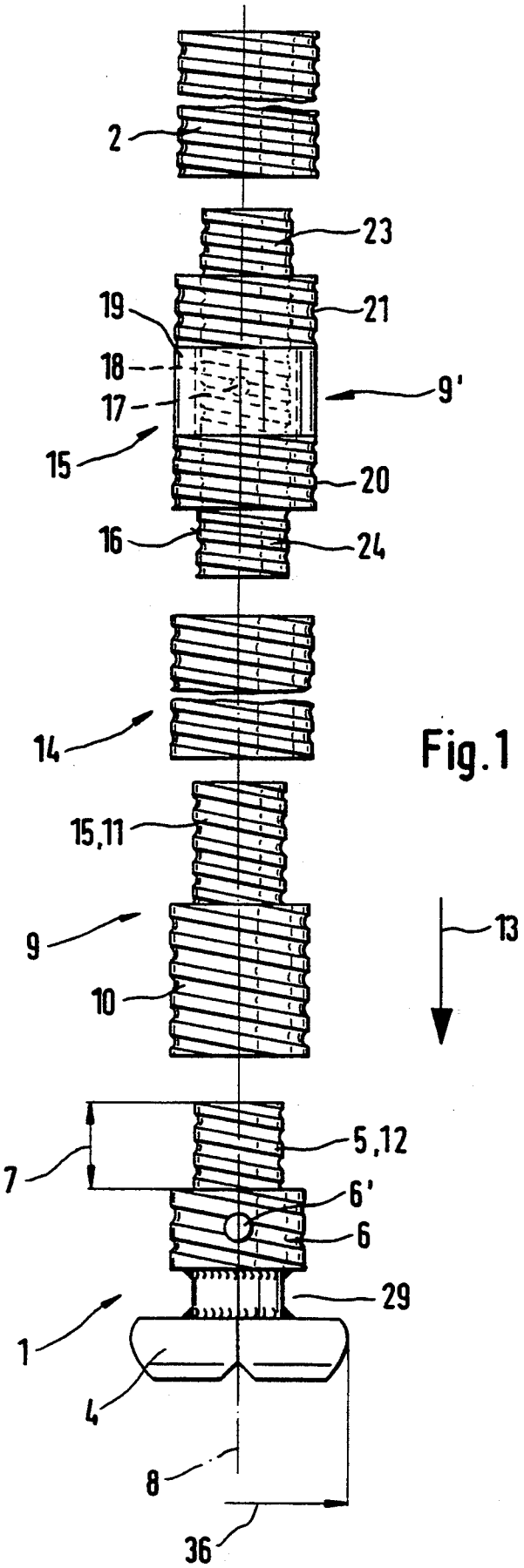
Fig. 1

DRILL PIPE

BACKGROUND OF THE INVENTION

The present invention relates to a drill pipe.

More particularly it relates to a drill pipe which has at least one tubular member provided with an external profiling and a central longitudinal passage throughout its length.

Drill pipes are known in many forms and for the most varied uses. They can be used for example as components of injection drilling anchors, which, as is known, correspond in structural terms to a drilling rod and after creation of the borehole remain in the borehole as a lost tool. In this case, after filling of the borehole with a cement suspension, the drilling rod is used in the manner of a rock anchor which, by means of an anchor head plate in combination with a tightening nut in the region of the mouth of the borehole, is tightened against the rock. For example, from DE-PS 936082, an injection drilling anchor is known at whose one end there is a drill head and at whose other end is fitted a removable threaded portion which serves for the screw fitting by means of the said tightening nut. The anchor rod is provided over its full length with helically wound beads as well as with transverse bores which are in permanent communication with a centrally extending longitudinal passage by means of which the rock debris created during the drilling process is carried away. After creation of the borehole, by means of the longitudinal passage as well as the transverse bores, a cement suspension is introduced into the borehole for the purpose of filling the borehole and anchoring the anchor rod. This suspension enters into any cracks and crevices in the rock and in particular, because of the bead-like configuration of the outside of the anchor rod, after hardening makes possible a secure positive anchorage between the anchor rod and the surrounding rock.

It is known, in the design of infection drilling anchors, to revert to structural components which are already known from drilling rods. For example, DE-PS 1483840 shows a rock drilling rod with a centrally arranged flushing passage which is provided in the region of a screwed-on drill head with outlet bores. The rock drilling rod or anchor red is extensible in use by means of a connecting sleeve which is provided with an internal thread into which is screwed a further anchor rod, with the inserted anchor rod additionally being equipped over its full length with a comparatively large thread in the manner of a circular thread. Such a rock drilling rod is basically; suitable for use as an injection drilling anchor, wherein the external thread of the anchor rod fulfils a transportation function during the drilling, in other words enabling the reverse flow of a flushing liquid which is charged with rock particles. In relation to the hardened cement the same thread fulfils an anchoring function, insofar as it produces the shape locking between anchor rod and surrounding borehole walls. Finally, the thread also fulfils a screw-fastening function, because it enables the screw fitting of a connecting sleeve, however with a drill head.

It is important for a trouble-free functioning of a rock anchor, particularly over the course of time, that it is arranged centrally within the borehole as far as is possible, so that a uniform cement overlay is provided around the anchor ever the full cemented length. A sufficient corrosion resistance is given only with an anchor which is reliably overlaid with cement. In practice, this requirement is often difficult to achieve, at without additional measures. If for example the anchor rod is arranged eccentrically because of spatial inhomogeneities along the wall of the borehole, then a uniform filling, especially overlaying or embedding of the drilling rod, cannot be guaranteed. An eccentric seating of the anchor rod within the cement body brings with it the danger that a part of the anchor rod will be subject to increased risk of corrosion, as a result of which in the course of time the main function of the rock anchor, namely the holding together of different rock strata, is brought into question.

From DE-PS 3828335 are known spacers used with injection drilling anchors, wherein these spacers consist of a retaining boss which directly surrounds the anchor rod and which is displaceable relative to the anchor rod. On this retaining boss are arranged three radially extending webs which are held together by an outer annular member. The use of this spacer means that during the creation of a borehole, and indeed before the introduction of an extension anchor rod, this spacer with its retaining boss is pushed over the end of the anchor rod which is already located in the borehole, wherein on the basis of a contact of the retaining boss against a coupling nut which makes possible the connection to an extension anchor rod, the spacer is introduced into the borehole together with the anchor rod during the further drilling extension. The position of the spacer is in this embodiment therefore established by the position of the coupling nut. During the drilling and after creation of the borehole there is in practice no or at least no simple possibility of examining the state of the spacer and the trouble-free functioning of the spacer. Thus, for example as a result of the high mechanical stresses during the drilling operation, and also due to local inhomegeneities of the bored rock, the spacer can be damaged, so that for these reasons under certain circumstances the centered effect no longer exists. Also, the spacer can prevent the leading away or extraction of rock particles by a flushing medium in many cases in dependence upon the local rock conditions as well as the properties of the rock particles which are freed as a result of the drilling process.

Finally, it is known in connection with the creation of so-called pre-drilled bores, to use spacers upon the setting in place of rock anchors, by means of which these are centered within the outer tube of the bore. It is known in these cases for the rock anchor to be introduced into a pipe filled with cement and to be held centered as far as possible within said pipe. The thus inserted spacer is of plastics material and is thus completely unsuitable in terms of its lack of strength for use with injection drilling anchors of the known type, in that they could scarcely withstand the high mechanical demands which are exerted during the drilling phase.

SUMMARY OF THE INVENTION

Accordingly, it is an object of the present invention to provide a drill pipe of the above mentioned general type, which avoids the disadvantages of the prior art.

In keeping with these objects and with others which will become apparent hereinafter, one feature of the present invention resides, briefly stated, in a drill pipe which has at least one tubular member provided with an external profiling and a central longitudinal passage throughout its length, wherein in accordance with the present invention the tubular member has over its whole length a regular internal thread which in combination with a coupling member is dimensioned and shaped to enable it to be fitted by screwing to at least one further similar tubular member.

When the drill pipe is designed in accordance with the present invention, it has optimum outflow conditions for a flushing medium which is charged during the drilling process with rock particles, and which is suitable in particular for use as an injection drilling anchor.

It is essential to the invention therefore that one uses a tube member as drill pipe which has a regular internal thread over its full length. This internal thread is in accordance with the invention designed in combination with a suitable coupling member for its extension, i.e. for the screwing on of a further tubular member, and this opens up the possibility of achieving this extension without the use of structural elements such as for example connecting sleeves or the like which project outwardly. This means simultaneously that the outside profiling of the tubular member remains regular and particularly remains smooth in spite of the extension, and indeed even in the connecting region between two tubular members. This means therefore that during the drilling operation one has optimum outflow conditions for the flushing medium which is charged with the freed rock particles, and indeed the flushing medium can flow uniformly along the whole length of the pipe. The uniform profiling also means that the drill pipe is suitable for use as an injection drilling anchor which consequently is subject to a uniform anchoring effect over its full cemented length. Finally, the uniform internal threading also means that it is possible to shorten the tubular member if necessary and to connect correspondingly shortened lengths with other drill pipes.

Further features of the invention are directed to an advantageous design of the external profiling of the drill pipe and of the tubular member, which is referred to hereinafter just as a thread. This opens up the further possibility of making the external and internal threads of the tubular member in one single working operation, for example by cold forming of the outside. In the extension case, i.e. in the case of the connection of two tubular members equipped in this sense, the threads therefore extend regularly over the full length of the drill pipe, and indeed with the result that over this full length a uniform conveying effect is exerted on the flushing medium which is charged with rock particles during the drilling process.

Other features of the invention are directed to a particularly advantageous embodiment of a coupling member which is easy to put into realisation. It is essential that this coupling member on the one hand is dimensioned in order to enable it to be screwed into oppositely disposed ends of the drill pipe and on the other hand should ensure, in as simple a manner as possible, equal screwed-in lengths for both the tubular members which are to be connected. This is achieved in a particularly simple manner in accordance with the invention in that the coupling member is in practice composed of two inter-engaged and thus coaxial tube portions, namely an outer tubular member provided at least with external threading and an inner tubular member inserted into this outer tubular member, for example by being screwed into it. The inner tubular member at the one end projects, preferably symmetrically, from the outer tubular member and with its projecting portions forms the threaded sections which are dimensioned to be screwed into two drill pipe members which are to be connected to each other. Consequently, in a particularly simple manner, the outer and inner tubular members are each formed as threaded tubular members which carry threads internally and externally, so that the outer tubular member can be screwed on to the inner and in a central position is secured thereto, preferably by welding. Because the outer tubular member corresponds in practice to a pipe tubular member in terms of its radial dimensions and its other properties, it is ensured in the case of connection that in spite of connecting two tubular members the outer surface of these in the connecting region has no external irregularities.

Further features of the invention are directed to a particularly advantageous embodiment of a drill head which—apart from its plate-like drilling crown—can be made from structural elements which correspond to those of the coupling member. It results in a drilling head which—starting from the drilling crown—first has an undercut region and which is dimensioned to be screwed to a drill pipe tubular member, i.e. to be screwed into this. For this purpose the drill head is equipped at its end remote from the drilling crown with a tubular portion provided with external threading and dimensioned to be screwed into the drill pipe tubular member. Immediately next to the drilling crown there is an inner tubular member to which a relatively short outer tubular member is screwed—having regard to the aforesaid undercut next to the drilling crown—wherein the tubular section of the inner tubular member projecting from the outer tubular member forms the tubular section dimensioned for screwing purposes, i.e. to be screwed into a drill pipe tubular member. The outer tubular member again forms a stop during the screw fitting to the drill pipe tubular member and is for the rest in terms of its radial dimensions as well as its external threading preferably identical with the drill pipe tubular member. In the screwed on state of the drill head there thus results, starting from the aforesaid outer tubular member up to the end of the drill rod, an externally uniform structure for the drill rod, and indeed even in the case of an extension.

The drill rod designed in the aforesaid manner can basically be used in a manner known per se as a drilling rod and rock anchor, namely as an injection drilling anchor.

Next features are particularly directed to the design of the drill pipe of the invention having regard to its use as an injection drilling anchor, and include in this connection special features which are concerned with the introduction of cement or some other hardenable material. In this connection the drill pipe includes a non-return valve in the region of the drill anchor near to the drilling head, as well as one or more injection. Both the aforesaid non-return valve and also the injection valve or valves are arranged in intermediate members which for their part are again dimensioned for screw fitting to drill pipe tubular members or anchor rod members which are to be connected to one another, thereby being screwed into one another. The number as well as the arrangement of the injection valves can be of any format depending upon the modular construction of the aforesaid intermediate members. In particular cases only a single non-return valve or one or more injection valves may be provided. It is essential in the case of the simultaneous use of non-return valves and injection valves that both are provided as spring-loaded valves which however must never simultaneously be in the open state. Thus, the non-return valve should only be open for the passage of the flushing medium during the drilling operation, when the comparatively low flushing medium pressure is not sufficient to open the injection valve, with the latter remaining in a closed state during the drilling and flushing process. Similarly, during the injection process, i.e. during the subsequent introduction of a cement suspension, which will be described in more detail hereinafter, the cement suspension should in practice flow only through the injection valves, as a result of which, because of the hardening of the original cement filling, the non-return valves are rendered functionless in this state and become blocked.

Further features of the invention are directed to the properties of the aforesaid intermediate members. The essential structural elements of these intermediate members are again inner and outer tubular members, wherein the outer tubular member again has threading on its inside and outside and is dimensioned in order to be screwed to the inner tubular member and in its radial dimensions again corresponds to the drill pipe or anchor tube member. Tubular sections of the inner tubular member projecting from the outer tubular member constitute again the screw fitting sections which are dimensioned to be screwed into adjacent anchor tube members. Again, the depth to which it is screwed in is again determined in a defined manner by means of the outer tubular member. The outer tubular members are again secured to the inner tubular members, preferably in their final screw fitted position, by welding.

Further features are directed to the construction of the injection valve. It is important that the sleeve member which performs the actual valve function and which can be made for example of a rubbery elastic material can be secured axially between two tubular cylinders of the same diameter, with these tubular cylinders corresponding in terms of their radial dimensions and their external properties to those of the anchor tube element provided with external threading. Preferably, two sleeve members are used, with an inner sleeve member of a relatively soft elastic material which performs a sealing function and with an outer sleeve member of an elastic, for example rubbery, material which performs a supporting function and if necessary has its elasticity properties modified by the use of a fabric. In the assembled state of this injection valve, the sleeve members merge into the "smooth" structure of the anchor rod, whether extended or not, in the same way as the tubular cylinder connecting these parts axially. The injection valve consequently has no structural elements projecting radially from the structure of the anchor rod which, as already mentioned above, might impede the flow of a flushing medium.

Further features of the invention are directed to a spacer which in terms of its practical use is designed specially for the drill pipe or anchor rod of the present invention. An important feature of this spacer is the provision of two centering members connected by means of radially outwardly projecting tie members which fulfil a spacing function, the centering members being dimensioned to be fitted over the anchor rod and wherein a separate push rod is provided for advancing the spacer, the push rod being engageable in a receiving device arranged on the guide member adjacent to the bottom of the borehole. The push rod is designed to be a push fit into the receiving device. It is important that the spacer is introduced into the borehole only after creation of the borehole, which is possible since the anchor rod has a uniform diameter over its full length in spite of possible extension rods as well as injection valves, and the resistance to displacement, at least of the centering member, is uniform along the whole anchor rod. This spacer is consequently introduced subsequently into the borehole along the anchor rod and indeed to the particular predetermined position. In the ordinary case several spacers are introduced at preset spacings, which is possible without difficulty with the aforesaid push rod. For the case in which, because of wall inhomegeneities, the introduction of the spacers encounters resistance, this is overcome by radial inward deformation of the tie members—after the pressure transfer by means of the push rod to the guide member closer to the bottom of the borehole—so that the wall inhomegeneities, for example a small reduction in the diameter of the borehole, can be overcome. For the contrary case in which the wall inhomegeneities constitute a certain measure of excess, resulting for example from a too excessive drilling, this cannot only be detected by the introductory resistance of the spacer but one can also establish the distance of this "fault zone" from the mouth of the borehole in the simplest manner. It is particularly advantageous that the spacer in terms of its strength does not need to be designed with reference to the mechanically very high demands of the drilling operation and can thus be made as a plastics part. However, it is preferably made of metal.

A guide member can be provided with a bore for receiving a push rod to an improved guidance of the push rod.

The centering bodies can be formed as tubular members. If necessary, the tubular member closer to the bottom of the borehole can have a rounded shape at its leading end so that it can slide over irregularities in the wall.

The push rod can be a push fit into the said receiving device. It must have an inherent rigidity which is sufficient to overcome the advance feeding resistance of the spacer. As long as it has this then a rolling body can be used as the push rod.

A special design can be provided for the end of an injection drilling rod which is closer to the mouth of the borehole. Again, the greatest possible use is made of the basic structural elements of the conventional components of the injection drilling anchor, namely tubular cylinders are provided with threads on the outside and preferably also on the inside, as well as tubular members which at least on the outside have a thread and are dimensioned and shaped to be pushed into or screwed into the said tubular cylinders. The last mentioned tubular members form the screw sections which are dimensioned to be screwed into an anchor rod member for example and the external threading of the tubular cylinders forms a permanent extension of the outer thread of the anchor rods. Consequently, the threaded sections of the "inner" tubular members dimensioned to be screw fitted are such that the said tubular cylinders lie in contact with corresponding contact surfaces of an anchor rod at their leading end. The tubular member projecting partially from the mouth of the borehole serves in the final assembled state of the injection drilling anchor, in combination with an anchor head plate and a tightening nut, to tighten the anchor down on to the rock. The last mentioned tubular member serves in accordance with the invention also for the push fitting of a plastics sleeve in order to ensure a so-called free anchor length in the region of the mouth of the borehole which is not cemented to the surrounding rock.

This plastics sleeve is pushed on to the adjacent tubular cylinder up to contact with the leading end so that the section of the tubular member surrounded by the sleeve is screened against any possible interaction effects with the cement.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 show an embodiment of an injection drilling anchor in accordance with the invention, with the greater part shown dismantled;

FIG. 2 shows a coupling member according to the invention for connecting two anchor rods;

DESCRIPTION OF PREFERRED EMBODIMENTS

Figure 3:
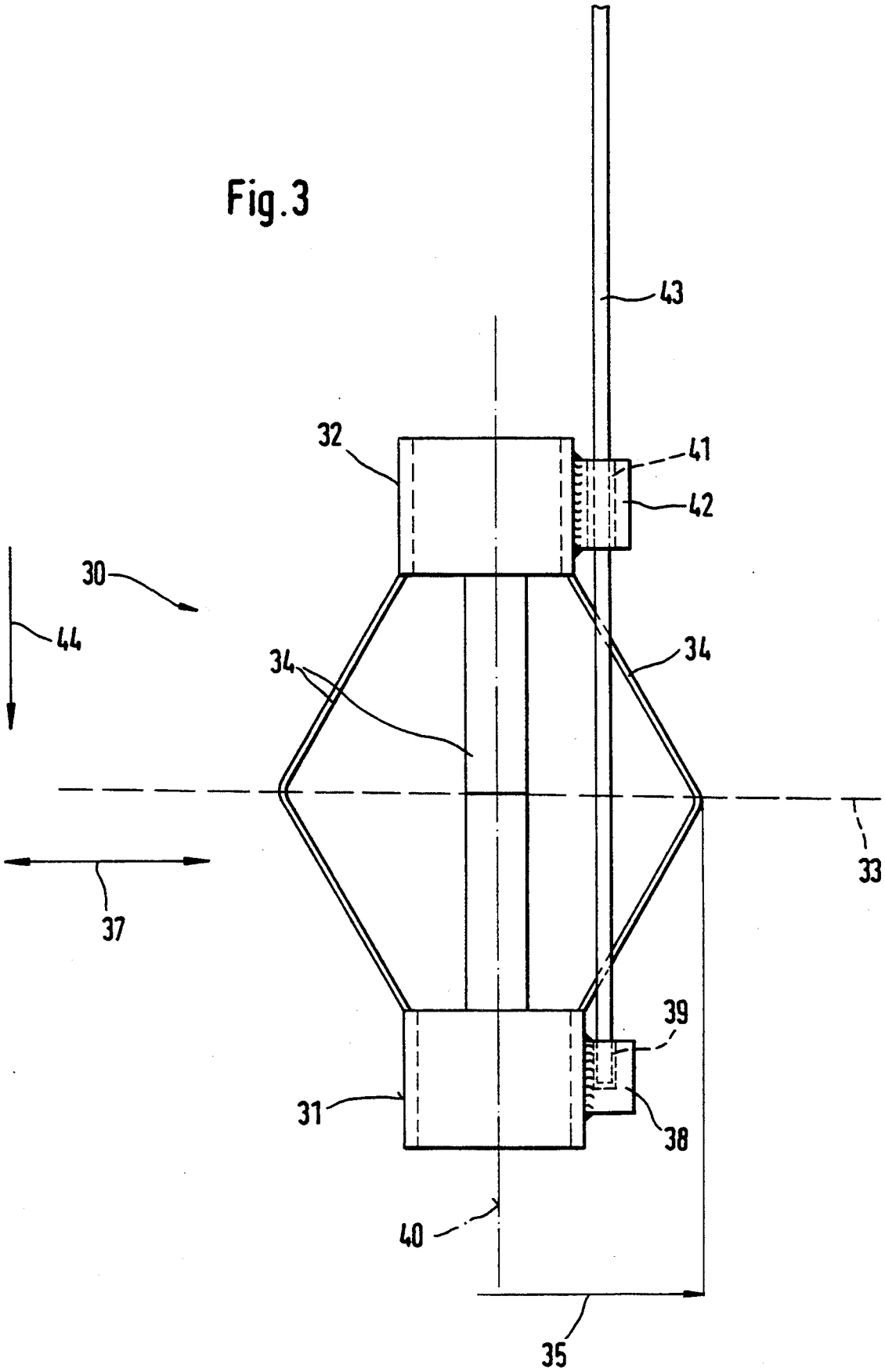
FIG. 3 shows an embodiment of a spacer according to the invention for use with injection drilling anchors according to FIG. 1.

The essential components of the injection drilling anchor shown in FIGS. 1 and 2 are a drill head 1, an anchor rod 2 and a coupling member 3 which is sized and shaped for the connection of two identical drill rods 2 below one another.

The drill head 1 consists of a plate-like drilling crown 4 which is comparatively short axially and which is equipped with cutting edges or the like. To the crown is welded a tubular member 5. The tubular member 5 is provided with an external thread over its full length. A tubular cylinder 6 is screwed on to this tubular member 5 and is welded to it in the fitted position. The tubular cylinder 6 is shorter in dimensions than the tubular member 5 and the fitted position is characterised by the fact that the tubular member 5 projects from the cylinder 6 by a distance 7 at the end of the tubular cylinder which is remote from the drilling crown 4. The tubular cylinder 6 is for its part provided with an external thread, the reason for which will be explained in more detail hereinafter.

A central longitudinal passage extending into an outlet bore of the drilling crown 4 which is not shown in the drawings extends along the axis 8. Additional outlet bores may be provided in the region of the drilling crown 4.

At 6' is indicated a transverse bore which extends through both the tubular member 5 and also the tubular cylinder 6 and provides communication with the aforesaid longitudinal passage. Through all the outlet bores, including the transverse bore or bores 6' a flushing medium, for example water or air, is passed during the drilling operation. After the making of the drill hole a cement suspension or another comparable hardenable medium is caused to flow into the borehole through these bores.

At 9 is indicated an intermediate member which consists overall of a tubular cylinder 10 and a tubular member 11. The tubular member 11 is screwed partially into the tubular cylinder 10 and can be fixed in the screwed-in position by welding for example. The tubular cylinder 10 for its part is designed to be screwed on to the tubular member 5, particularly on to its tubular section 12.

The intermediate member 9 incorporates a non-return valve which is not shown in the drawings and which is arranged within the longitudinal passage which extends along the axis 8. This non-return valve is spring-loaded and operates at a predetermined pressure. It is arranged such that under pressure it releases a through flow in the direction of the arrow 13, while preventing a reverse flow in the direction opposite to the arrow 13. The reason for this non-return valve will be described in more detail hereinafter.

It is essential that in the position where the intermediate member 9 is screwed on to the drill head 1 the tubular cylinders 6 and 10 should be in direct contact with one another.

At 14 is indicated an anchor rod member which corresponds in terms of its diameter to the tubular cylinders 6 and 10 and which is provided on the outside as well as on the inside with a thread extending over its full length. The anchor rod member 14 can have an individually adapted length and, in the assembled state, is screwed on to the tubular section 15 of the tubular member 11 which projects from the tubular cylinder 10, such that the anchor rod member 14 at its lower end is in contact with the tubular cylinder 10.

At 15 is indicated an injection valve which consists of a tubular member 16 which has one or more transverse bores 17 in a central region, with these bores being equally distributed circumferentially if there is more than one. The transverse bores 17 are surrounded by a first sleeve member 18 of a relatively soft elastic material, which for its part is surrounded on the outside by a coaxial sleeve member 19 which is also of elastic material and which exerts a supporting function. The sleeve members 18 and 19 create a reliable sealing of the transverse bores 17 in the state where the tubular member 16 is without pressure internally.

At 20 and 21 are indicated comparatively short tubular cylinders which are screwed axially on to the tubular member 16 at respective ends of the sleeve members 18, 19 and which provide axial retention for the sleeve members. The tubular cylinders 20, 21 can be secured in the final screwed-on position by being welded to the tubular member 16. The tubular cylinders 20, 21 as well as the sleeve member 19 are dimensioned to have the same diameter. The tubular cylinders 20, 21 in combination with the sleeve members 18, 19 have an axial length overall such that at both ends of the injection valve 15 tubular portions 23 and 24 are created which can be screwed into the anchor rod member 14 on the one hand and into the anchor rod 2 on the other hand. The reason for the injection valve 15 and its method of operation will be described in more detail hereinafter.

The components embracing the injection valve 15 constitute a further intermediate member 9'. The design of the injection valve in the manner described above is not absolutely necessary and it could have other, alternative forms. It is only essential that the injection valve should have no component projecting radially beyond the tubular cylinders 20, 21 and that it should function in the manner of a spring-loaded non-return valve which first opens the pressure which is necessary for the subsequent injection, while remaining in the closed state during the flushing process.

An essential feature of the coupling member 3 shown in FIG. 2 is again a tubular member 25 which corresponds in terms of its diameter to the tubular members 5, 11, 16 and which carries, approximately in the middle, a screwed-on tubular cylinder 26 which corresponds in diameter to the anchor rod 2. Tubular portions 27 and 28 of the tubular member 25 extend approximately symmetrically on both sides of the tubular cylinder 26. The position of the tubular cylinder 26 can be secured by welding it to the tubular member 25.

The coupling member 3 serves for the coupling of a further anchor rod 2 such that its tubular portions 27, 28 are screwed into the anchor rod ends to be connected, and indeed such that the ends of the anchor rods to be connected are in direct contact with the tubular cylinder 26.

It is a basic feature of the injection drilling anchor according to the invention that there are anchor rods 2 and anchor rod elements 14 which are provided both internally and externally with a thread over their entire length, and wherein the individual elements of this drilling anchor, namely drill head 1, intermediate members 9, 9', anchor rod member 14, anchor rod 2 and further anchor rod portions 2 connected by means of coupling members 3, are all fixed to one another by internal screw threads. Because of the fact that the anchor rods 2 and 14 are provided over their full length with a uniform internal and external threading, these can be shortened as necessary in any manner and can be adapted to the particular needs. By an appropriate length dimensioning of the tubular portions 12, 15, 23, 24 one achieves in the simplest way an arrangement in which the final screwed in position is determined by the length dimension of these tubular portions and consequently no further stops are necessary. The same applies also for the coupling member 3 whose central tubular cylinder 26 exerts a stop function for the adjacent ends of the anchor rods which are screwed on to the tubular portions 27 and 28.

It will already be appreciated from the description given above that the injection drilling anchor according to the invention, in spite of being composed of different functional elements, in the assembled state has an external contour beginning with the tubular cylinder 6 of the drilling crown 1 which is characterised by an external thread of uniform character extending up to the region of the borehole mouth, and which also has no parts projecting beyond this contour. Apart from the threaded configuration of the outside of the anchor, the assembled injection drilling anchor has an externally "smooth" surface.

This injection drilling anchor is used, in a manner known per se, primarily as a drilling rod, i.e. a flushing medium, for example water or alternatively air, flows through the central longitudinal passage which extends in the direction of the axis 8. This flushing medium exits during the drilling operation only through the outlet bores in the drilling crown 4 and through the transverse bores 6' of the drill head, taking away the rock particles which are freed by the drilling crown 4 as a consequence of the drilling operation, in order to flush these in the direction opposite to that of the arrow 13, thus in the direction towards the mouth of the borehole. Simultaneously, the flushing medium exerts a cooling effect on the drilling crown. It is particularly advantageous that an undercut zone 29 is provided immediately behind the drilling crown 4, considered in the direction opposite to that of the arrow 13. This favours the removal of the freed rock particles or of the other drilled matter.

As already mentioned above, the spring-loaded non-return valve arranged within the intermediate member 9 as well as within the aforesaid longitudinal passage is dimensioned such that it opens under the pressure at which the flushing medium is present during the drilling operation, and permits a through flow in the direction of the arrow 13. The injection valve 15 on the other hand is designed by appropriate use of materials and other means for the sleeve members 18 and 19 that it does not open under the flushing pressure, so that this injection valve 15 is in practice without any function during the drilling operation.

The uniform external thread extending over the whole length of several anchor rods 2 is advantageous during the drilling operation, in that by means of this, not only is a conveying effect exerted on the rock particles which are to be removed from the borehole, but also, because of the substantially "smooth" surface of the injection drilling anchor which is characterised by having structural elements without external projections, optimum through flow conditions are created for the flushing medium charged with drilled matter.

After completion of the drill hole, the injection drilling anchor, particularly its longitudinal bore, is used for the introduction of a cement suspension or some other hardenable medium which, in a first phase, exits only through the outlet bores and other transverse bores of the drill head 1, and gradually fills up the borehole, beginning with the foot of the borehole and rising in the direction opposite to that of the arrow 13. After complete filling of the borehole a reverse flow of the cement suspension into the said longitudinal passage is prevented by means of the non-return valve within the intermediate member 9.

After this the longitudinal passage is flushed out in order to remove any cement suspension remaining therein.

After hardening of the initially introduced cement, a renewed introduction of cement suspension is effected, which now is under high pressure and exits through the injection valve 15. The pressure of this cement suspension introduced under compression is such that it causes an opening of the injection valve 15 which during the initial introduction of cement was practically without function and had sealed off the transverse bores 17. During this injection, a further passage of cement suspension out through the drill head 1 does not take place or scarcely takes place.

By means of the cement suspension exiting through the injection valve 15, the body of cement surrounding the injection drilling anchor in this region and undergoing the hardening process at least in the initial phase cracks open and further cement suspension flows into the borehole to take up the gaps forming between the particles. On account of the high pressure of the cement it spreads out, strongly reinforcing gaps within the rock and the said cement body is in part considerably enlarged.

The process of flushing out the longitudinal passage, as well as the fresh introduction of cement and splitting of the cement body, can be repeated several times, with the splitting being effected by cement or alternatively being possible also by the use of water. As a result, the body of cement encircling the injection drilling anchor is widened in the region of the injection valve and a reliable anchoring effect is produced. Naturally, one or even several injection valves may be provided along the structure of the rock anchor, which, because of the modular design of the individual structural elements of the injection drilling anchor, can be introduced into this structure at practically any points.

It is important for a reliable functioning of an injection drilling anchor, particularly when considered over a period of time, that there should be an overlay of a cement or some other hardenable material which is as uniform as possible and which is effective on all sides within the borehole. This serves also to achieve a sufficient corrosion resistance and consequently to achieve uniform strength properties of the total system consisting of injection drilling anchor and surrounding cement. Particularly with comparatively long boreholes and multi-part injection drilling anchors there is always the danger of skewing faults, so that in order to centre the anchor the use of spacers is customary, which are supported against the borehole wall and exert a centering action on the anchor rods.

FIG. 3 shows one example of a spacer according to the invention, which is specially designed for cooperation with an injection drilling anchor as shown in FIGS. 1 and 2.

In FIG. 3 the spacer is indicated overall at 30. The spacer comprises inter alia two axially spaced tubular members 31 and 32 or centering bodies, which are coaxial with respect to each other and which are shaped and dimensioned in terms of their diameter so that they will slide over anchor rods 2 and tubular cylinders 6, 10, 14, 20 and 21 of the same diameter. These tubular members 31, 32 are smooth on both the inside and outside and are connected by a system of four elastic tie members 34 which are arranged symmetrically in relation to a radial central plane 33. If necessary, further such tie members 34 can be provided, and preferably equispaced circumferentially. It is important that—with reference to the central plane 33—the parts of the tie members located respectively above and below this central plane 33 are positioned on the surface of cones whose bases lie in the central plane 33.

In the relaxed state, the degree of inclination of the tie members 34 is such that the maximum radius 35 in the region lying in the central plane 33 corresponds at most to the radius 36 of the drilling crown 4.

The system of tubular members 31, 32 and tie members 34 is made of steel in the embodiment which is illustrated in FIG. 3. In this embodiment the tie members 34 are welded in a suitable manner to the tubular members 31, 32 or are connected to them in some other manner. It is to be noted however that it is alternatively possible to make these spacers from a suitable plastics material.

So far as their elasticity is concerned, the tie members 34 are dimensioned such that there is a certain degree of springiness possible in the direction of the arrow 37, although in every case there must be a sufficient supporting function for the anchor rods which are guided in the tubular members 31, 32, and indeed such that these anchor rods are held centred as far as possible within the borehole. Further reference to this will be made hereinafter.

At 38 is indicated a socket member welded to the outside of the tubular member 31. The socket member is provided with a blind bore 39 which extends parallel to the axis 40 of the tubular member. Coaxially in relation to the blind bore 39 there extends a bore 41 through a guide member 42 which is welded on to the tubular member 32.

The blind bore 39 and the through bore 41 have approximately the same diameter and serve to receive a push rod 43 which is arrested in its movement in the direction of the arrow 44 in the blind bore 39 and which is freely movable in relation to the through bore 41.

A brief description will now be given of the use of the injection drilling anchor according to the invention.

The device is used primarily as a drill rod provided with a drill head, wherein a flushing medium, for example air, is guided through the central longitudinal passage. The flushing medium picks up rock particles freed as a result of the drilling operation and carries these out through the annular chamber between the inside wall of the borehole and the outside of the anchor rods in the direction towards the mouth of the borehole. After creation of the borehole, as soon as this has reached its final depth, a first spacer 30 is pushed over the end which is at the mouth of the borehole. Its tubular members 31, 32—as already explained above—are dimensioned such that they can be pushed without noticeable resistance over the anchor rods 2, injection valves 15, coupling members 3 and the like. The fitting of the spacer 30 is effected in such a manner that the tubular member 31 which is fitted with the socket member 38 is located at the end adjacent to the foot of the borehole.

The advancing movement of the spacer 30 is effected by the use of the push rod 43 which acts directly on the tubular member 31 which is adjacent to the foot of the borehole and consequently exerts, by means of the tie members 34, a tractive force on the tubular member 32 which is at the end nearer the mouth of the borehole. The degree of inclination of the tie members 34 in the central plane 33 is arranged to be such that the region of maximum radius of the tie members 34 rests resiliently against the borehole wall, so that the tubular members 31, 32 and consequently also the anchor rods 2 are guidingly centred. The push rod 43 must have such a length as in practice to correspond to the final assembly position of the spacer. It can be made of an elastic material which can be unwound for example from a roll but which nevertheless has at least sufficient inherent stiffness to be able to bring about the aforesaid tractive force.

It is important, for the situation where there are unevennesses in the borehole wall which would, among other things, block a further advancement of the spacer and which would exert a holding back effect on the angled tie members 34, that there should be a certain lenghtening of the spacer on the basis of the compression force transfer to the tubular member 31, and consequently an overcoming of these wall unevennesses during its advance along the drill rod. It is particularly advantageous in this connection if the external diameter of the injection drilling anchor is practically the same as the drill head, so that an advancing movement of the spacer is not prevented in any way by any structural elements projecting from the outer surface.

If the unevenness of the wall of the borehole should reach a sufficient degree that in spite of the elastic springiness of the tie members 34 in the direction of the arrow 37 a further advancement of the spacer is not possible, then it has to be concluded that the borehole wall at the particular point of the blockage has a completely insuperable condition. Thus, the state of the borehole is controllable by means of the introduction of the spacer.

Simultaneously, the final position of the spacer 30 within the overall length of the borehole can be established by means of the length of the push rod 43. After the spacer 30 has in this way reached its final position, the push rod 43 is removed in the direction opposite to that of the arrow 44, so that as a consequence of the outward springing of the tie members 34 the spacer is fixed sufficiently in its position.

Subsequently, in the same manner, depending upon the overall length of the injection drilling anchor, further spacers 30 can be introduced in predeterminable positions along the overall length of the borehole and can be fixed in the same manner in contact with the borehole wall. As a result, the injection drilling anchor is in the end centred sufficiently over its full length within the borehole, so that the cement suspension can then subsequently be introduced.

The latter is not hindered by the spacers retainers, since comparatively large-volume throughflow spaces remain between the individual tie members 34, so that a uniform filling is possible. The aforesaid non-return valve 9, as well as the injection valve or valves 15 are used as already described above during the introduction of the cement.

In the final state the injection drilling anchor is consequently overlaid by a uniform layer of cement extending over its full borehole length, and consequently is given a correspondingly reliable corrosion resistance. Because of the true and unequivocal centering of the anchor rod or rods within the borehole one achieves uniform strength properties for the anchoring in relation to the surrounding rock, and for the rest this injection drilling anchor is utilised just as a conventional injection drilling anchor, i.e. an anchor plate together with nut is set over the part projecting from the mouth of the borehole. However, in the representation shown in the drawings these two structural elements which are known per se have been omitted.

Figure 4:
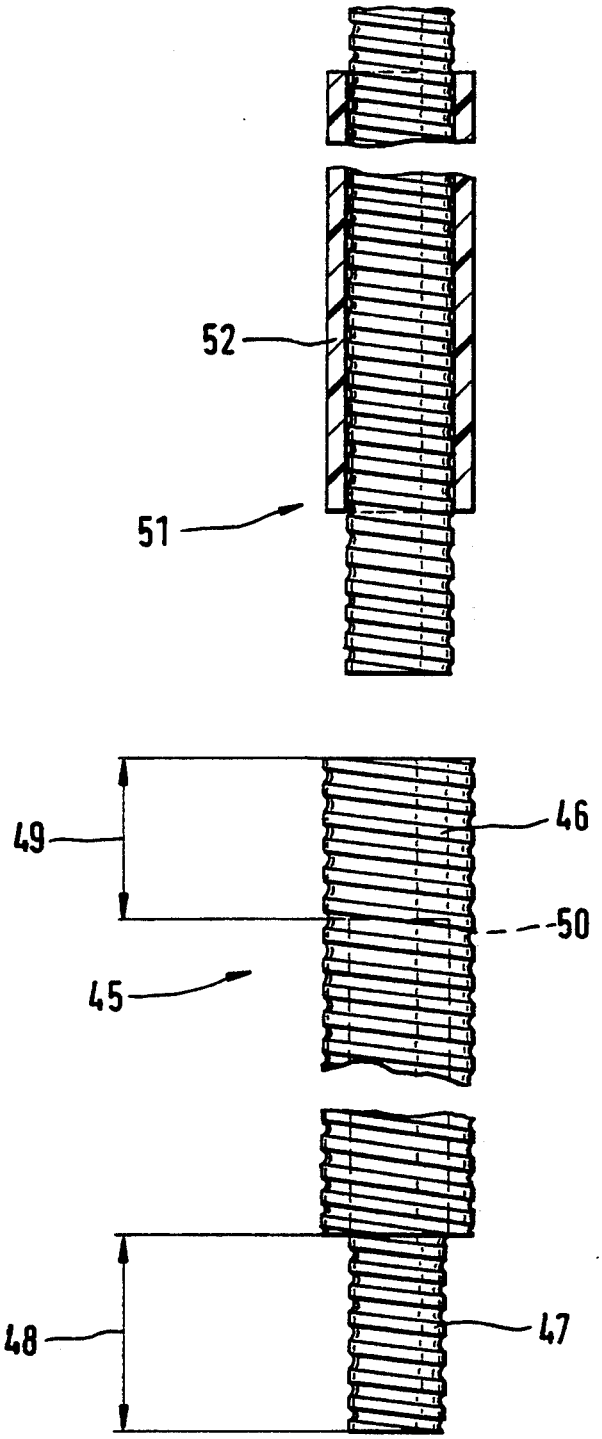
FIG. 4 shows the end region of an injection drilling anchor according to FIG. 1 at the borehole mouth end, for the greater part in a dismantled state.

At 45 in FIG. 4 is indicated a terminating member which consists overall of a tubular cylinder 46 which, in terms of its external and internal threads as well as its radial dimensions, corresponds to the anchor rod 2. Into this tubular cylinder 46 is screwed a tubular member 47, and indeed such that it projects from the first component at one end by a longitudinal distance 48. This projecting portion of the tubular member 47 forms a screwing section which is designed to be screwed into one end of an anchor rod 2, and indeed such that in the screwed-in state the tubular cylinder 46 is in direct contact with the anchor rod 2 and thus constitutes an extension thereof.

The end 50 of the tubular member 47 which is remote from the screw-in section is located within the tubular cylinder 46, and indeed up to a distance 49 from its adjacent end. This end thus forms a stop or a screw-in limit for an end piece 51 which, in terms of its external thread as well as its radial dimensions, corresponds to the tubular member 47. This end piece 51 is the end projecting from the mouth of the borehole which in the final state of the injection drilling anchor serves for the screw fitting of a tightening nut and an anchor plate.

In accordance with the invention, a plastics sleeve 52 is fitted over this end piece 51. The tube can be made for example of PVC (polyvinyl chloride). In the screwed-in state of the end piece 51 the plastics sleeve 52 is in contact in substantial sealing manner with the associated end of tubular cylinder 46 and, by means of the length dimension of this plastics sleeve 52, the free length of the injection drilling anchor at the end adjacent to the mouth of the borehole and which is not cemented to the borehole wall, is determined, since the plastics sleeve 52 excludes any adherence between this end piece 51 and the surrounding cement.

It will be understood that each of the elements described above, or two or more together, may also find a useful application in other types of constructions differing from the types described above.

While the invention has been illustrated and described as embodied in a drill pipe, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A drill pipe useable as an injection anchor, comprising at least one anchor rod having a predetermined length and provided with a throughgoing external profiling and a throughgoing longitudinal passage, said anchor rod having a uniform internal thread over said length; a coupling member, said internal thread in combination with said coupling member being dimensioned and shaped so that it can be screwed to at least one further similar anchor rod; a drill head provided at least with one axial outlet bore and including a tubular portion screwable into an end of said anchor rod, said coupling element including a base member having a longitudinal passage and an end provided with a threaded portion arranged to be screwed into said anchor rod, said coupling member also having an annular member carried on said base member and performing a stop function, said annular member having a diameter corresponding to a diameter of said anchor rod and also having an external profiling corresponding to said external profiling of said anchor rod, said tubular portion of said drill head and said coupling member having an external thread for screwing into said anchor rod, said anchor rod with said coupling member being provided with at least one of a uniform external diameter and a uniform thread-like profiling starting from said tubular cylinder of said drill head and extending to an end facing away from said drill head; a plurality of intermediate members provided with at least one injection valve, each of said intermediate members having two ends and being provided with a tubular portion at at least one of said ends, said tubular portion of said intermediate members being dimensioned and shaped to be fully screwed into adjacent ends of said anchor rod, said injection valve having a tubular member with at least one transverse bore and an external profiling and at least one sleeve member composed of elastic material and sealingly closing off said tubular member in the region of said transverse bore, said sleeve member being arranged coaxially relative to said tubular member and having two ends provided with tubular cylinders having an external profiling and fixed relative to said tubular member, said tubular cylinders and said sleeve member of said injection valve having substantially identical external diameters, said anchor rod and said tubular cylinders of said injection valve having the same diameter and corresponding external profiling.

2. A drill pipe as defined in claim 1, wherein said base member of said coupling element is formed as a tube provided with an external profiling, said annular member of said coupling element being formed as a relative short outer tube which is fixed to said base member.

3. A drill pipe as defined in claim 1, wherein said drill head has an axially short, plate-like drilling crown provided with cutting edges, a tubular member fixedly connected with said drilling crown, and a tubular cylinder which is shorter than said tubular member and has a diameter corresponding to a diameter of said drill pipe and is provided with an external profiling, said tubular cylinder being connected with said drilling crown through an undercut and also being connected with said tubular portion.

4. A drill pipe as defined in claim 1; and further comprising a non-return valve provided in a region adjacent said drill head in said longitudinal passage, said non-return valve being spring loaded and arranged in said intermediate member, said intermediate member having two ends and being provided with a tubular portion at least at one of said ends, said tubular portion of said intermediate member being dimensioned and shaped to be fully screwed into adjacent ends of said anchor rod.

5. A drill pipe as defined in claim 4, wherein said intermediate member which has said non-return valve including a tubular cylinder which surrounds a tubular member carrying said tubular portion, said intermediate member having a diameter corresponding to the diameter of said anchor rod and being provided with an external profiling corresponding to an external profiling of said anchor rod.

6. A drill pipe as defined in claim 1; and further comprising a spacer dimensioned and shaped to be pushed over said anchor rod located in a borehole.

7. A drill pipe as defined in claim 6, wherein said spacer has two centering members provided with bores which are coaxial relative to one another and arranged axially spaced from each other, and elastically deformable radially extending tie members connecting said centering members with one another and fulfilling a spacing function, said centering members including a leading centering member arranged to be located adjacent to a foot of the borehole and provided with a receiving device; and further comprising a push rod for which said receiving device is provided in order to advance said spacer within the borehole.

8. A drill pipe as defined in claim 7, wherein said centering members including a centering member remote from a bottom of the borehole and provided with a guide member having a bore to receive said push rod in order to guide said push rod, said centering members being formed as tubular members, said push rod being fitted into said receiving device as a socket fit.

9. A drill pipe as defined in claim 1; and further comprising a plastic sleeve; and a closure at an end adjacent to a mouth of the borehole and dimensioned and shaped for said plastic sleeve to be pushed over said closure.

10. A drill pipe as defined in claim 9, wherein said closure has a closure member dimensioned to be screwed to an end of said anchor rod and also having an end piece dimensioned so that said plastic sleeve can be pushed on said end piece and to be fitted to a tightening nut, said end piece being dimensioned and shaped to be screwed to said closure member and formed as a tubular member provided with an external profiling and having radial dimensions corresponding to radial dimensions and said tubular members of said drilling crown and said injection valve.

11. A drill pipe as defined in claim 10, wherein said closure member has a tubular cylinder having radial dimensions and external profiling corresponding to radial dimensions and external profilings of said anchor rod, and a tubular part fitted in said tubular cylinder and having a radial dimension corresponding to a radial dimension of said tubular member, said tubular part having one end which is located within said tubular cylinder and forms a stop for screwing in of said end piece, said tubular part having another end projecting from said tubular cylinder and dimensioned to be screw fitted to an end of said anchor rod.

* * * * *